US008210843B2

(12) United States Patent
Lin

(10) Patent No.: US 8,210,843 B2
(45) Date of Patent: Jul. 3, 2012

(54) GAS TORCH

(75) Inventor: Arlo Lin, Taichung (TW)

(73) Assignee: Pro-Iroda Industreis, Inc., Taichung (TW)

( * ) Notice: Subject to any disclaimer, the term of this patent is extended or adjusted under 35 U.S.C. 154(b) by 232 days.

(21) Appl. No.: 12/701,650

(22) Filed: Feb. 8, 2010

(65) Prior Publication Data

US 2010/0261129 A1 Oct. 14, 2010

(30) Foreign Application Priority Data

Apr. 8, 2009 (TW) ..... 98111645 A
Dec. 18, 2009 (TW) ..... 98143644 A

(51) Int. Cl.
*F23D 14/26* (2006.01)
*F41H 9/02* (2006.01)
*F23Q 2/00* (2006.01)
*B23K 7/10* (2006.01)

(52) U.S. Cl. ..... 431/344; 431/91; 431/142; 266/77

(58) Field of Classification Search ..... 431/91, 431/142, 344; 266/77
See application file for complete search history.

(56) References Cited

U.S. PATENT DOCUMENTS 6,065,959 A * 5/2000 Tsai ..... 431/255
7,527,496 B2 5/2009 Lin ..... 431/344

* cited by examiner

*Primary Examiner* — Kenneth Rinehart
*Assistant Examiner* — William Corboy
(74) *Attorney, Agent, or Firm* — Alan Kamrath; Kamrath IP Lawfirm, PA

(57) ABSTRACT

A gas torch includes a torch head assembly including a coupled base and a connected portion coupled to an outer periphery of the coupled base. A joint assembly, which is coupled to the coupled base and adapted for connecting to a nozzle of a bottled gas tank, includes a first joint member and a second joint member communicating with the first joint member. Two fasteners are inserted through the first and second joint members and engaged with the coupled base of the torch head. The joint assembly enables the torch head assembly to connect to different kinds of gas tanks.

18 Claims, 21 Drawing Sheets

GAS TORCH

BACKGROUND OF THE INVENTION

1. Field of the Invention

The present invention relates to a gas torch.

2. Description of the Related Art

Referring to U.S. Pat. No. 7,527,496, it discloses that a gas torch includes a first safety switch abutted against a tube which is provided inside of a through-hole. A second safety switch is pivotally connected to and able to pivot with respect to the tube. The second safety switch is abutted against an abutted portion of a controlling member. Thus, the first and second safety switches can avoid danger if children play with this gas torch.

However, in use, a user's hand has to hold on the gas tank, because there's no component provided on the gas torch for holding firmly. Further, this gas torch can only connect to one kind of gas tank. It is not convenient to use this gas torch on different occasions.

SUMMARY OF THE INVENTION

According to the present invention, a gas torch includes a torch head assembly, an engagement plate and a joint assembly. The engagement plate is adapted to connect the joint assembly to the torch head assembly, and the joint assembly is adapted for coupling a bottled gas tank to the gas torch.

One objective of the present invention is that the engagement plate is tilted toward a direction opposite the torch head assembly outwardly and that a user's hand can be placed between the engagement plate and the bottled gas tank firmly. It prevents the gas torch from dropping on the ground.

Another objective of the present invention is that the engagement plate is able to rotate with respect to a connected portion of the torch head assembly so that a torch head of the torch head assembly can be driven to various angles with respect to the joint assembly.

Another objective of the present invention is that the torch head can connect to various kinds of bottled gas tanks via different kinds of joint assemblies easily.

Other objectives, advantages, and features of the invention will become more apparent from the following detailed description when taken in conjunction with the accompanying drawings.

BRIEF DESCRIPTION OF THE DRAWINGS

The present invention will be described via detailed illustration of the two embodiments referring to the drawings.

DETAILED DESCRIPTION OF THE PREFERRED EMBODIMENTS

Figure 1:
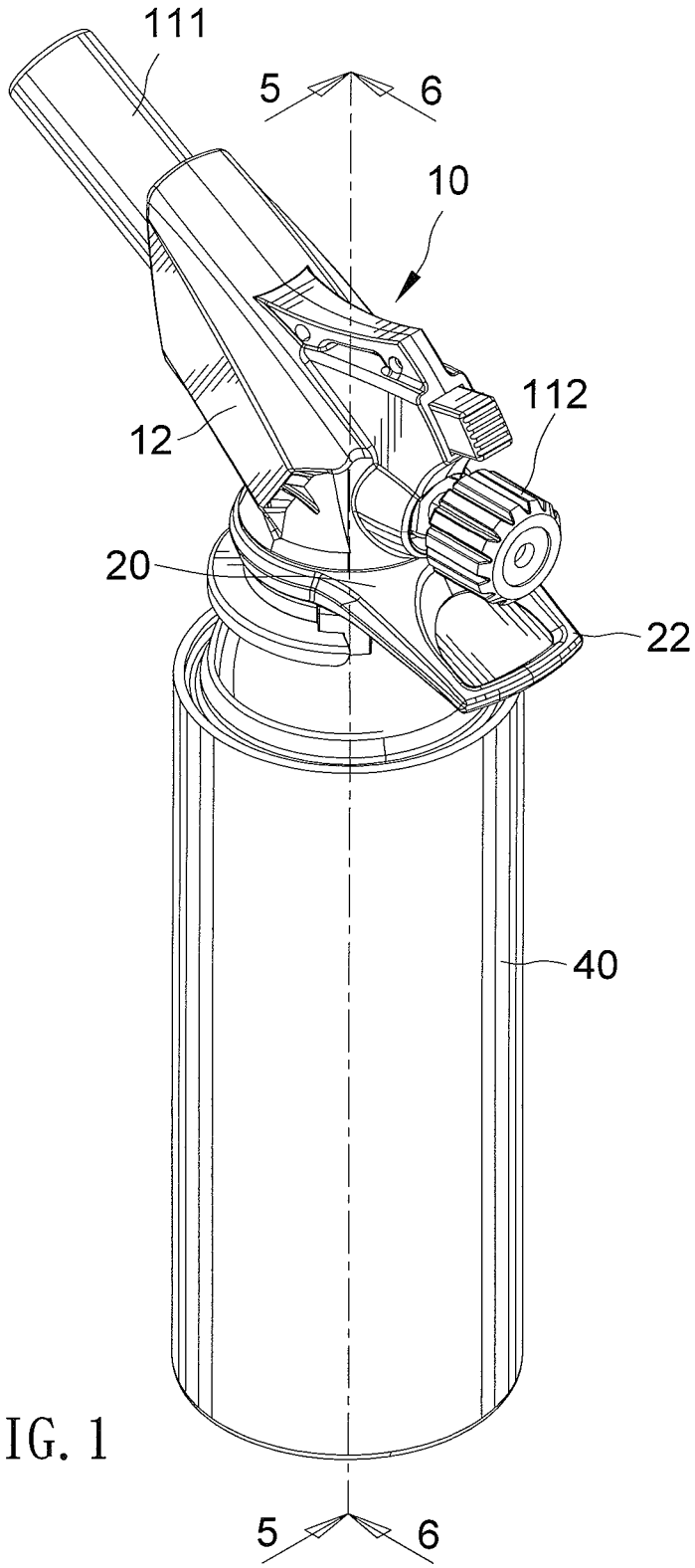
FIG. 1 is a perspective view of a gas torch according to the first embodiment of the present invention.
Figure 2:
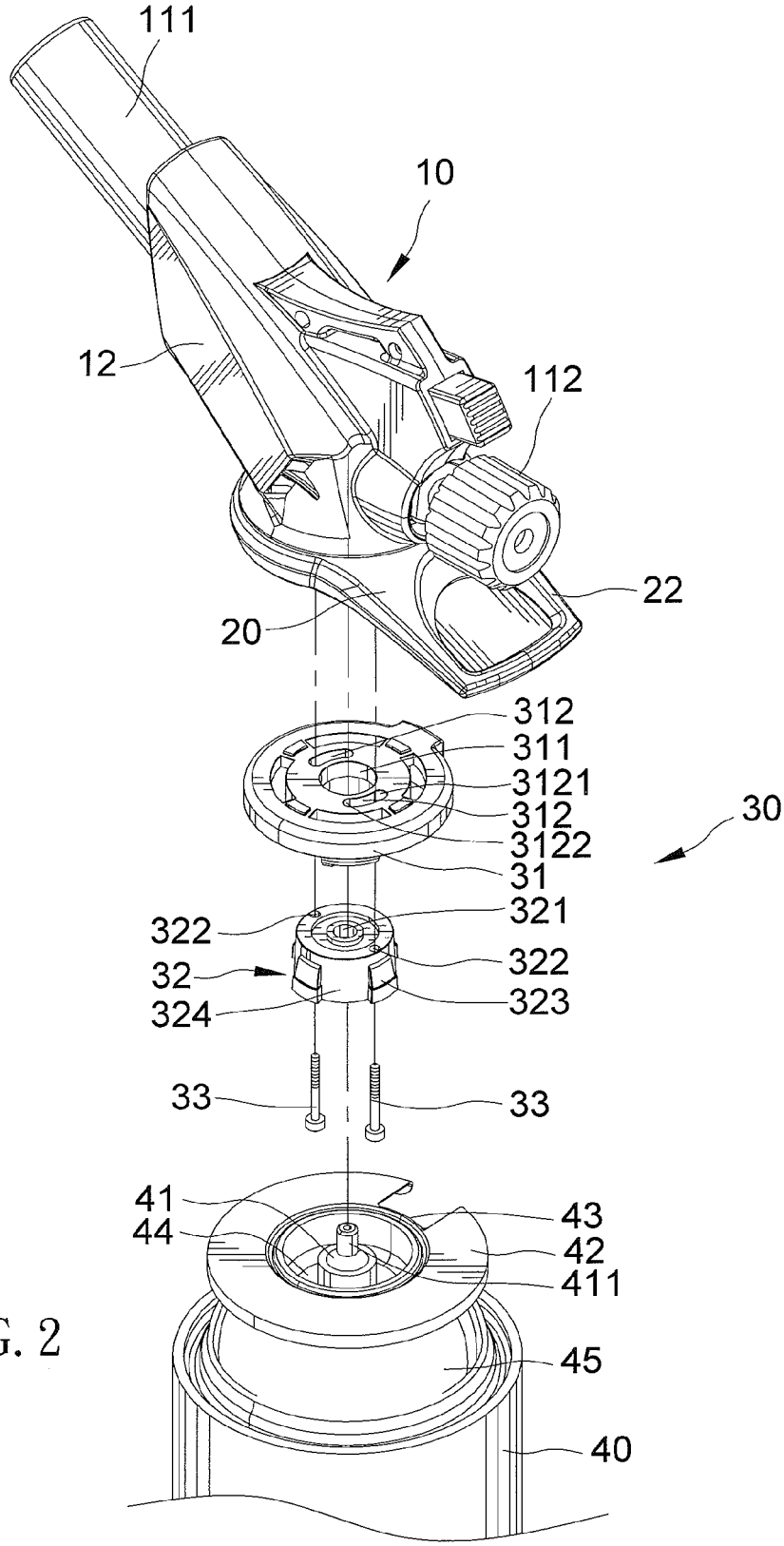
FIG. 2 is an exploded perspective view of the gas torch shown in FIG. 1.

FIGS. 1 through 6 show a gas torch in accordance with a first embodiment of the present invention. The gas torch includes a torch head assembly 10, an engagement plate 20 and a joint assembly 30 adapted to connect the torch head assembly 10 to a bottled gas tank 40. The engagement plate 20 is installed between the torch head assembly 10 and the joint assembly 30.

The torch head assembly 10 includes a torch head 11 and a casing 12. The torch head 11 includes a tube 111 installed to an end thereof for spraying flame from burning gas and an adjusting button 112 provided to another end thereof and opposite to the tube 111 for controlling air intake of the bottled gas tank 40 and further adjusting flame size sprayed via the tube 111. A coupled base 113 is provided between the two ends of the torch head 11 transversely. An abutted portion 114 and a coupled portion 115 are defined on the bottom side of the coupled base 113. The coupled portion 115 protrudes from the center of the abutted portion 114 and includes a mounted ring 1151 provided therein and a channel 116 formed in the center thereof for gas passing through. Two opposite coupled holes 117 are formed on the abutted portion 114 and surrounding the coupled portion 115.

The casing 12 covers two sides of the torch head 11, and the tube 111 and the adjusting button 112 respectively protrude from two ends of the casing 12. In this case, the casing 12 has two halves which are combined to each other. A connected portion 121 is formed on the outer periphery of the bottom of the casing 12 and corresponding to the coupled base 113. After assembling, the connected portion 121 is provided around the outer periphery of the coupled base 113. A plurality of limited protrusions 122 is formed on the distal end of the connected portion 121.

The engagement plate 20 includes a mounted portion 21 mounted on the connected portion 121 of the casing 12 and an engaged portion 22. The engagement plate 20 is able to rotate with respect to the torch head assembly 10. A flange 211 is defined on the inner periphery of the mounted portion 21, and several notches 212 are formed on the flange 211 and correspond to the limited protrusions 122 of the casing 12. Via combination of the limited protrusions 122 and the notches 212, the mounted portion 21 of the engagement plate 20 is mounted onto the connected portion 121. By rotating the engagement plate 20, the flange 211 would restrict the limited protrusions 122. The engaged portion 22 extends from a side of the mounted portion 21 transversely and forms a receptacle 221 for setting labels or trademarks thereupon. Moreover, the engaged portion 22 is tilted toward a direction opposite to the torch head assembly 10 outwardly. A distance between the distal end of the engaged portion 22 and the center of the gas torch is larger than a distance between the outer periphery of the bottled gas tank 40 and the center of the gas torch or a distance between the distal end of the adjusting button 112 and the center of the gas torch.

The joint assembly 30 includes a first joint member 31 installed to the coupled base 113 and a second joint member 32 coupled to the bottled gas tank 40 and communicating with the first joint member 31. A through-hole 311 is formed through the first joint member 31 and mounted on the coupled portion 115 of the torch head 11. Two opposite limited holes 312 are formed on the first joint member 31 around the through-hole 311 and in this case, in the form of long grooves. Each limited hole 312 has a first end 3121 and a second end 3122 and allows the first joint member 31 to rotate with respect to the second joint member 32 and the coupled base 113. The top side of the first joint member 31 is abutted against the coupled base 113, and the bottom side of the first joint member 31 forms four combined portions 313 which are spaced from each other and extend toward the second joint member 32 around the through-hole 311. In this case, each combined portion 313 is resilient and able to move with respect to the second joint member 32 longitudinally. A block 314 protrudes from a side of the outer periphery of the first joint member 31, and a slot 315 is formed on a side of the block 314 transversely.

The second joint member 32 includes an orifice 321 communicating with the through-hole 311 of the first joint member 31 and the torch head assembly 10 and having first and second sections 3211 and 3212. The first section 3211 is adjacent to the first joint member 31 and the second section 3212 is opposite to the first joint member 31, with respect to the first section 3211 and engaged with the bottled gas tank 40. Two opposite engaged holes 322 are formed on the second joint member 32 around the orifice 321. The first and second joint members 31 and 32 are coupled to the coupled base 113 via two fasteners 33 inserted through the two engaged holes 322 and the two limited holes 312 and engaged with the two coupled holes 117 in a screw manner. The torch head assembly 10 is able to pivot with respect to the joint assembly 30 via the two limited holes 312. Four projections 323 and four receptacles 324 are formed on the outer periphery of the second joint member 32. Each receptacle 324 is defined between each two of the projections 323 and is inserted by the related combined portion 313. An inner diameter of each combined portion 313 is larger than an outer diameter of each receptacle 324 and smaller than an outer diameter of each projection 323.

The first joint member 31 is able to be driven to rotate between a first position and a second position with respect to the second joint member 32, and the combined portions 313 are able to move between the projections 323 and the receptacles 324. In the first position of the first joint member 31, the fasteners 33 are driven to the first ends 3121 of the limited holes 312, and the combined portions 313 are positioned in the receptacles 324. In the meanwhile, the first joint member 31 is not abutted against and able to rotate with respect to the second joint member 32. In the second position of the first joint member 31, the fasteners 33 are driven to the second ends 3122 of the limited holes 312, and the combined portions 313 are tightly abutted against the projections 323 so that the first and second joint members 31 and 32 are abutted against each other.

Figure 15:
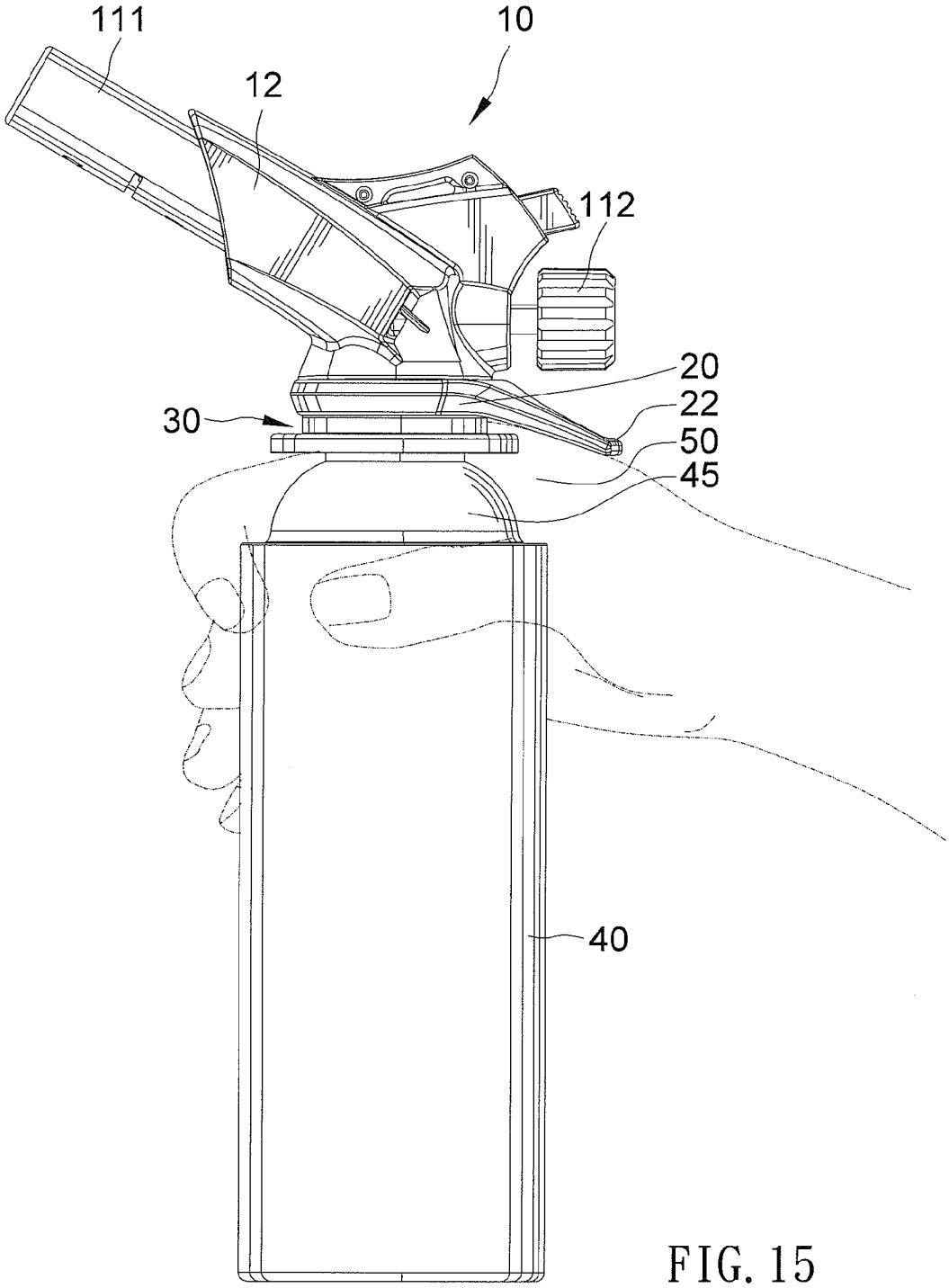
FIG. 15 is a side view of the gas torch shown in FIG. 1, illustrating a user's hand holding on the bottled gas tank.

In this case, the bottled gas tank 40 is in the form of a gas cartridge and includes a nozzle 41 protruding from the center thereof and having a connector 411 which is inserted through the orifice 321 and engaged with the coupled portion 115. The mounted ring 1151 of the coupled portion 115 is tightly mounted to the connector 411 in an air-tight manner so that gas stored in the bottled gas tank 40 would not leak from the coupled portion 115. An engaged disc 42 is annularly provided to the periphery of the nozzle 41 and forms a gap 43 thereon. A space 44 is defined between the nozzle 41 and the engaged disc 42. A neck 45 is provided at the bottled gas tank 40 and connects a body (not numbered) of the bottled gas tank 40 to the nozzle 41. A compartment 50 is formed between the neck 45 of the bottled gas tank 40 and the engagement plate 20 (as shown in FIG. 15). In use, a user holds on the gas torch, and a user's hand is placed onto the compartment 50.

The joint assembly 30 is coupled to the torch head assembly 10 via the though-hole 311 of the first joint member 31 mounted onto the coupled portion 115 of the torch head 11, and two fasteners 33 are inserted through the engaged holes 322 of the second joint member 32 and the limited holes 312 of the first joint member 31 and are engaged with the coupled holes 117.

Figure 8:
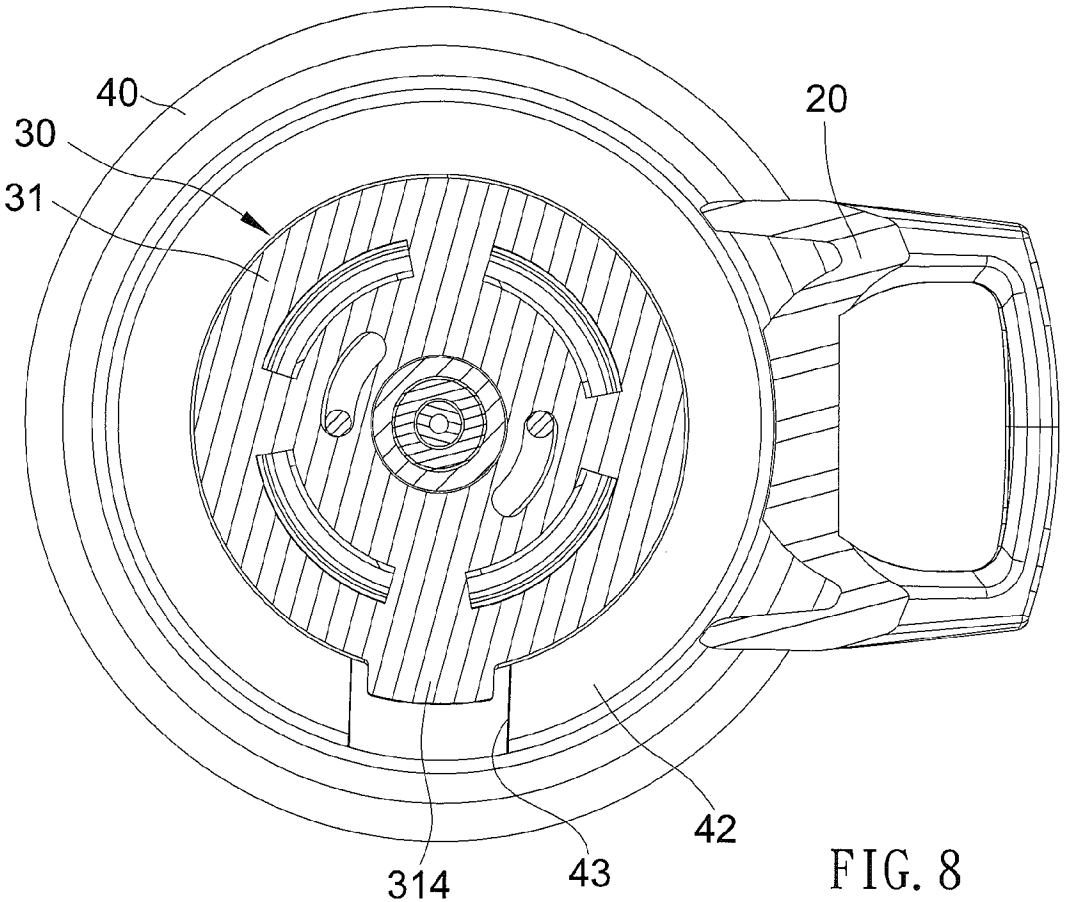
FIG. 8 is a cross-sectional view taken along line 7-7 in FIG. 5.
Figure 9:
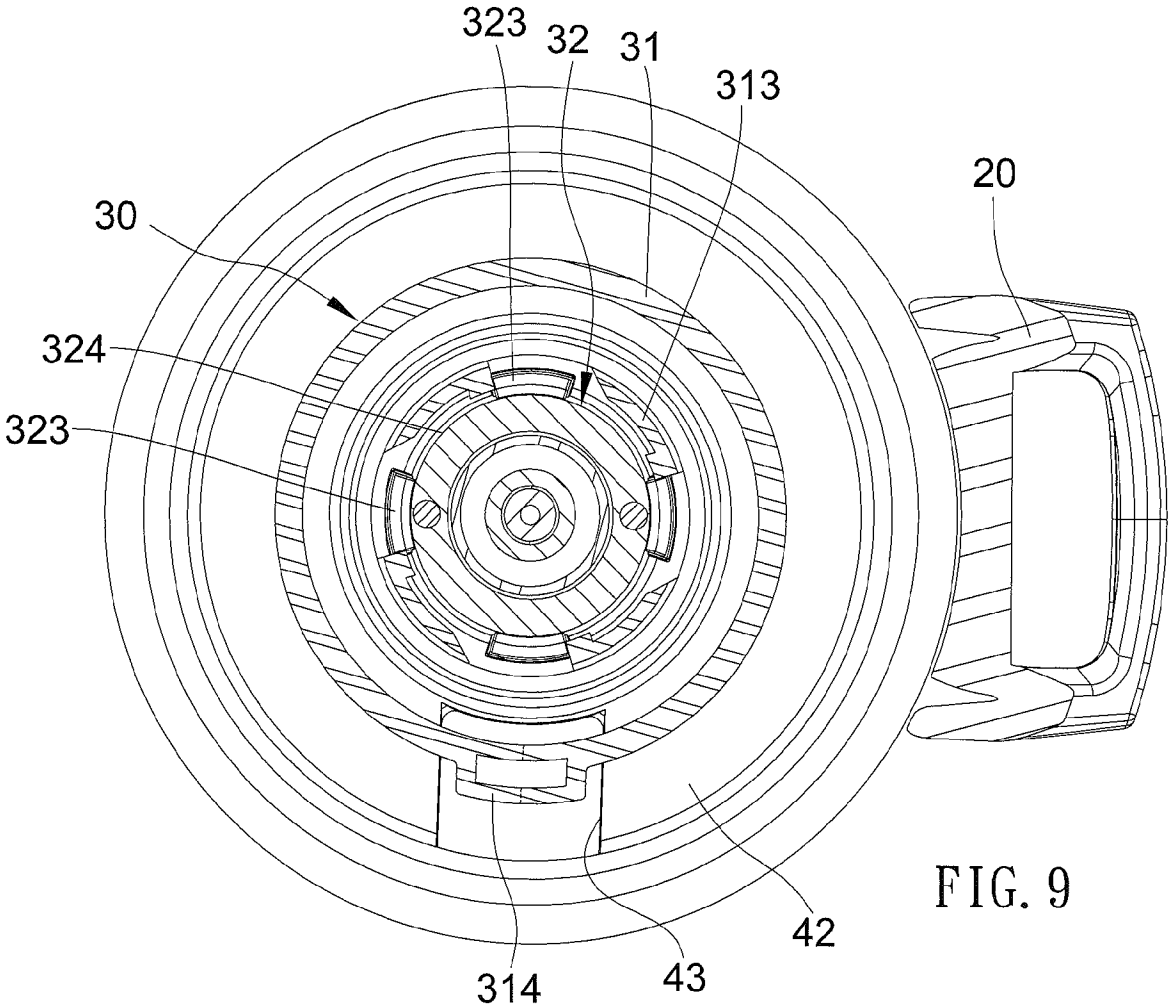
FIG. 9 is a cross-sectional view taken along line 8-8 in FIG. 5
Figure 10:
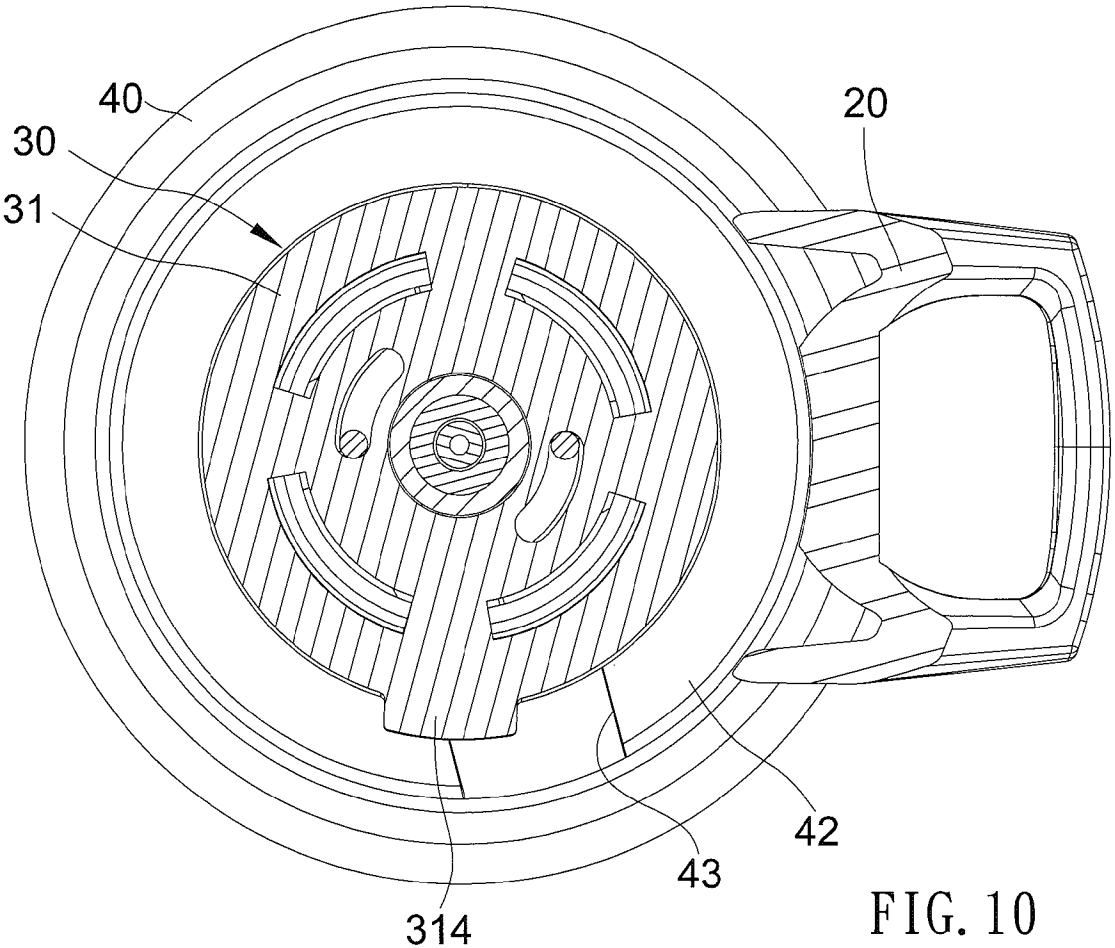
FIG. 10 is a cross-sectional view similar to FIG. 8, illustrating the first joint member driven to be in the second position with respect to the second joint member.
Figure 11:
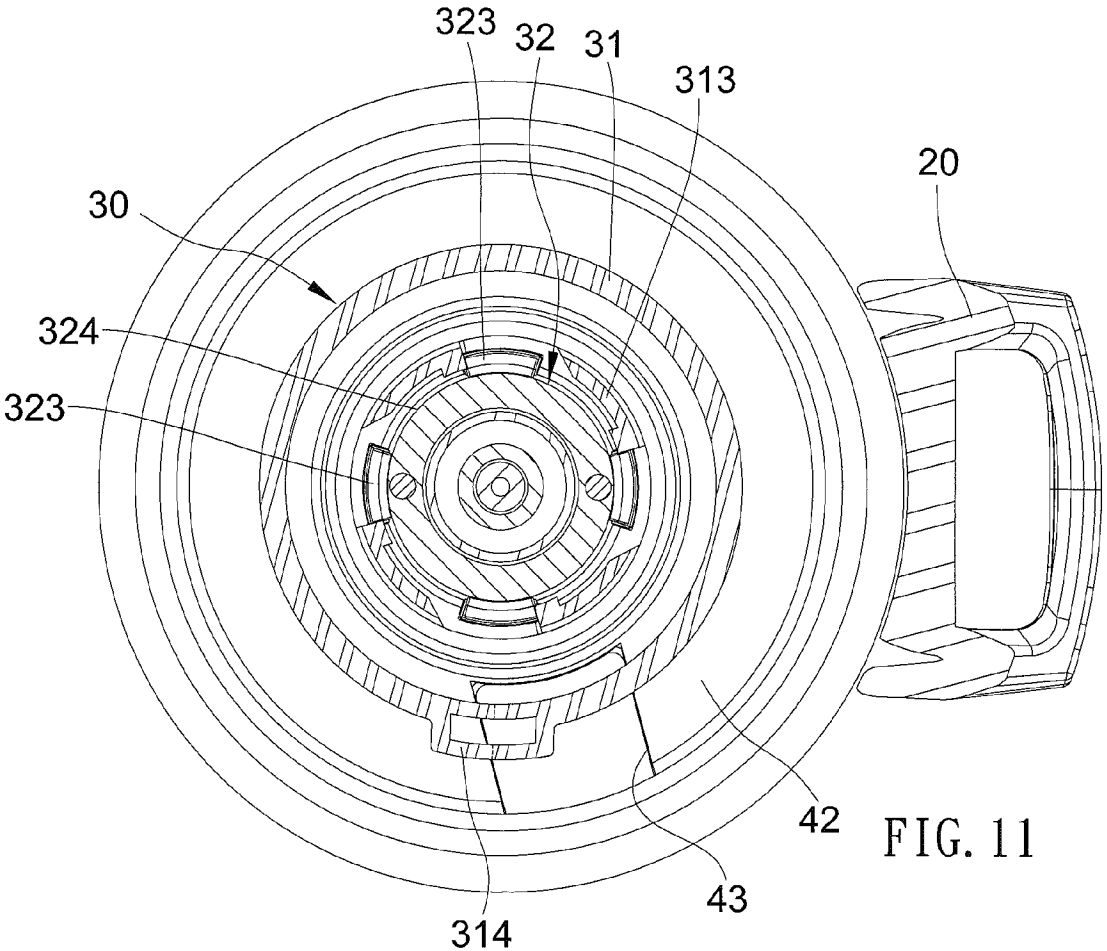
FIG. 11 is a cross-sectional view similar to FIG. 9, illustrating the first joint member driven to be in the second position with respect to the second joint member.
Figure 12:
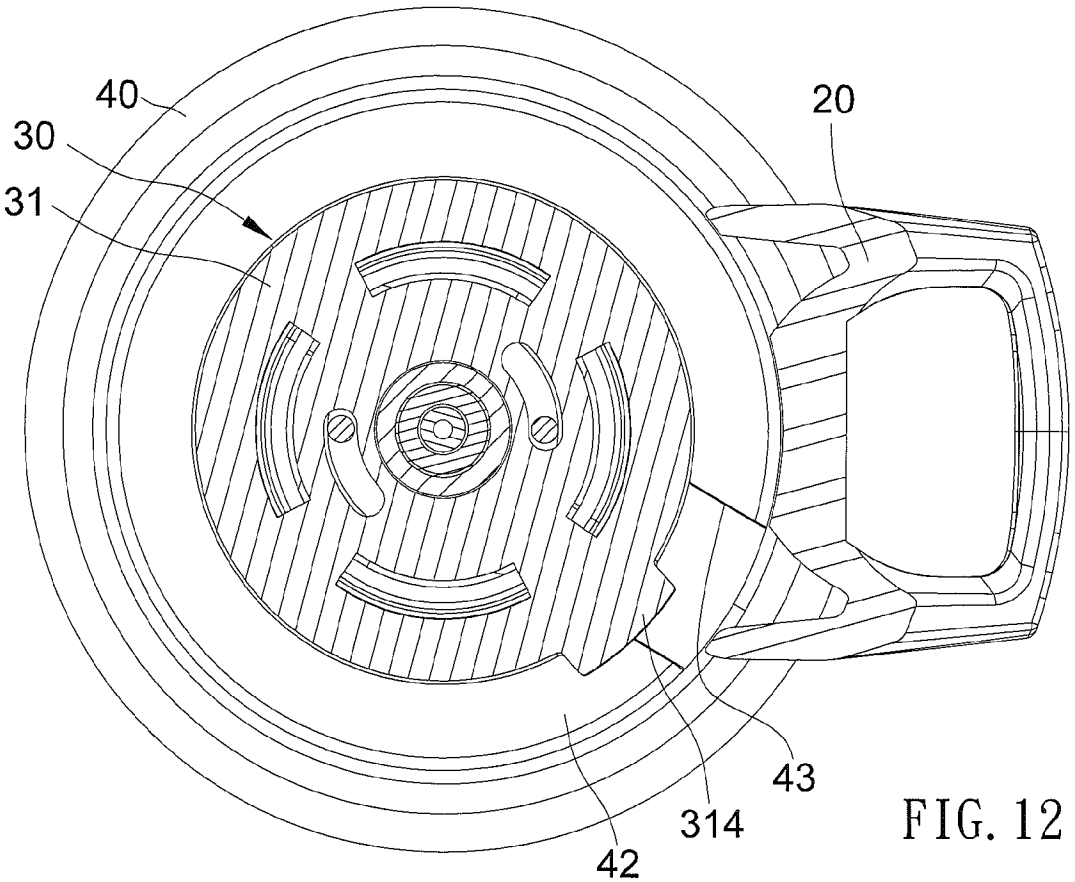
FIG. 12 is a cross-sectional view similar to FIG. 10, illustrating the bottled gas tank going to drive the combined portion of the first joint member to engage with the projections of the second joint member.

Further referring to FIGS. 8 and 9, while the first joint member 31 is in the first position, the block 314 of the first joint member 31 can be inserted through the gap 43 of the bottled gas tank 40 so that the user can install the bottled gas tank 40 to the joint assembly 30.

Figure 3:
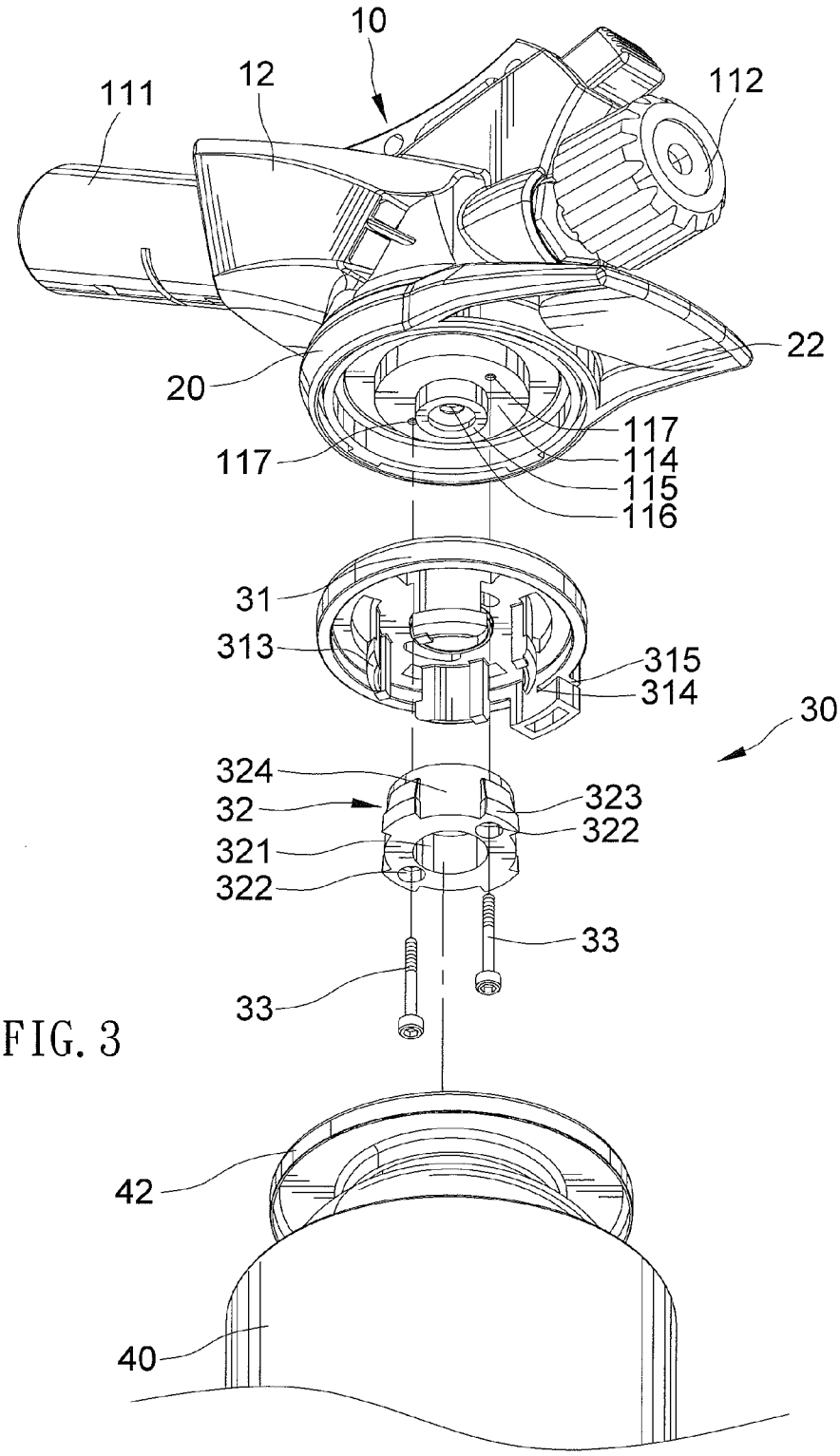
FIG. 3 is another exploded perspective view of the gas torch shown in FIG. 1.
Figure 7:
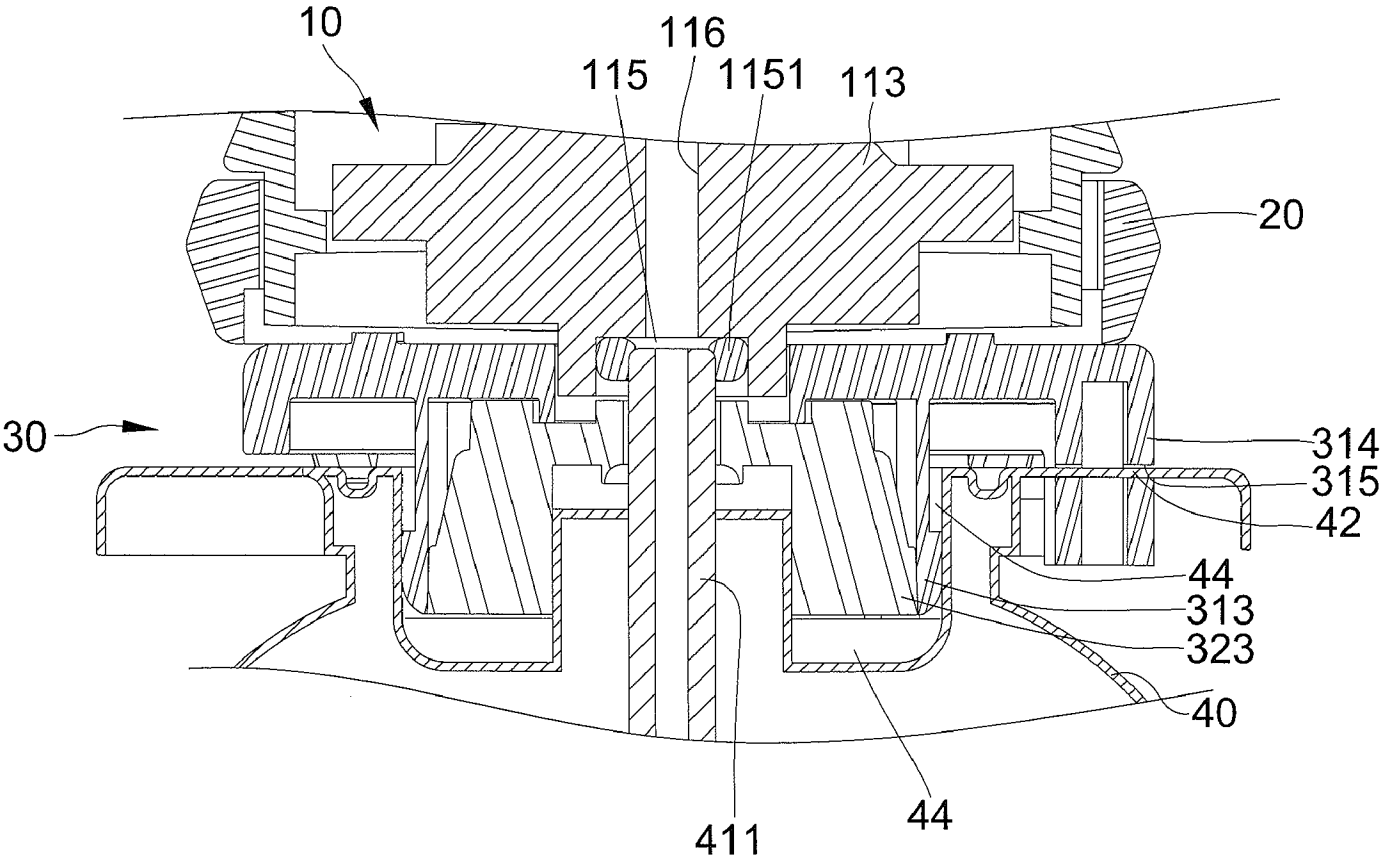
FIG. 7 is a cross-sectional view similar to FIG. 6, but illustrating the combined portions of the first joint member respectively abutted against the projections of the second joint member to fittingly couple the joint assembly to the space of the bottled gas tank.
Figure 13:
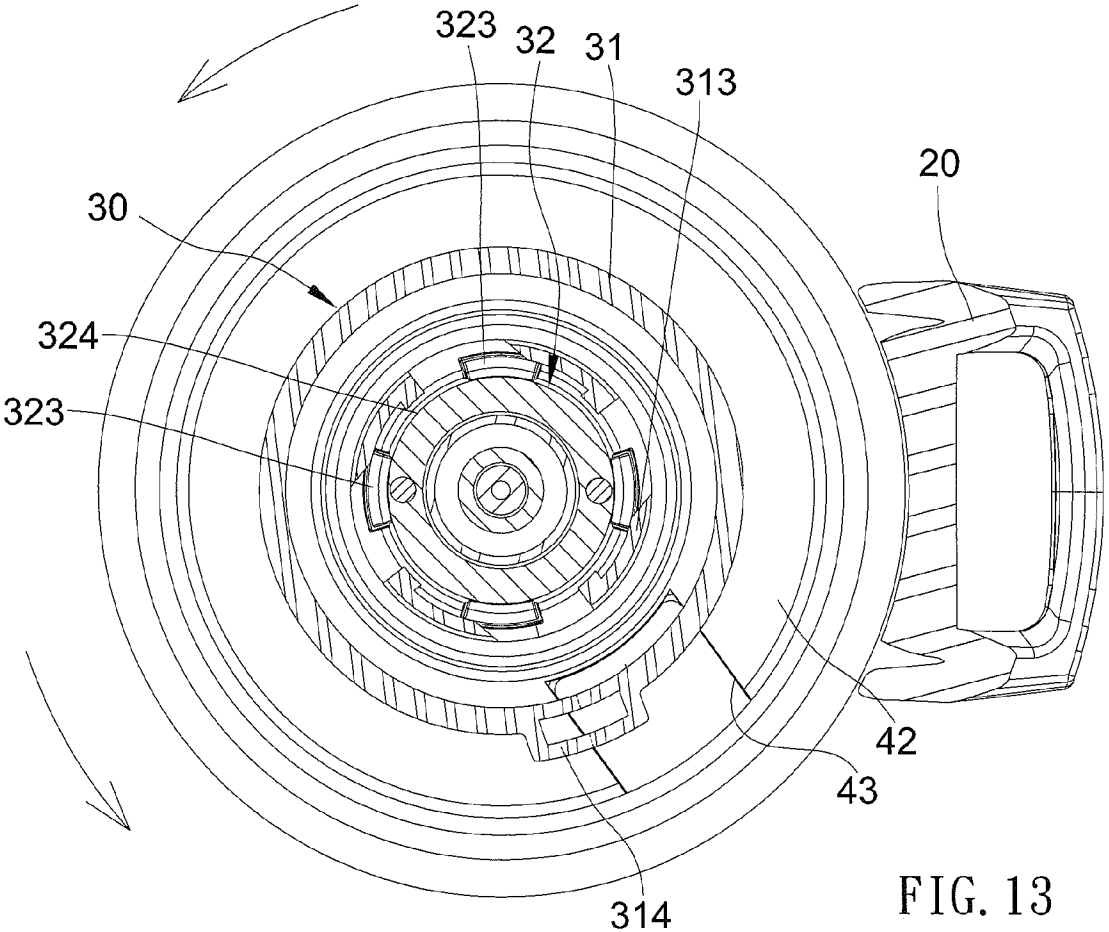
FIG. 13 is a cross-sectional view similar to FIG. 11, illustrating the bottled gas tank going to drive the combined portion of the first joint member to engage with the projections of the second joint member.
Figure 14:
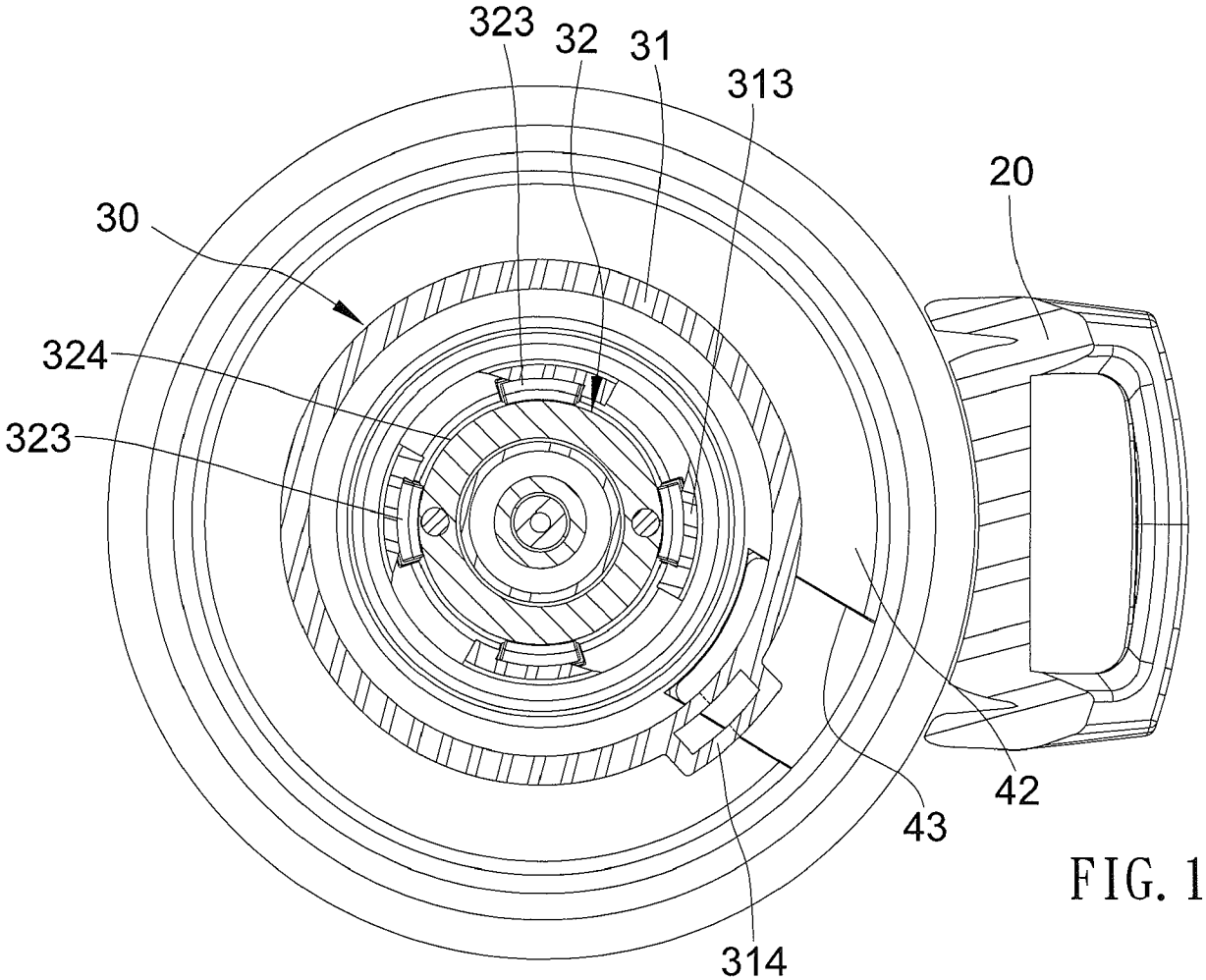
FIG. 14 is a cross-sectional view similar to FIG. 10, illustrating the combined portions of the first joint member engaging with the projections of the second joint member.

Referring to FIGS. 7 and 10 through 14, the user rotates the bottled gas tank 40 counterclockwise, and the engaged disc 42 is driven to engage with the slot 315 (as shown in FIG. 3). Further, while the bottled gas tank 40 is still driven to rotate, the first joint member 31 is driven to rotate to the second position with respect to the second joint member 32. Hence, the first and second joint members 31 and 32 are abutted against each other tightly. FIG. 7 shows the combined portions 313 of the first joint member 31 respectively engage with the projections 323 of the second joint member 32 tightly, and, further, the projections 323 of the second joint member 32 are abutted against the inner wall of the space 44 of the bottled gas tank 40. Hence, the joint assembly 30 is firmly coupled to the bottled gas tank 40 via a combination of the combined portions 313, the projections 323 and the space 44. In this case, the combined portions 313 and the projections 323 are flexible so that the above combination would be tightly-coupled, and the bottled gas tank 40 can be stably installed to the gas torch and prevents the bottled gas tank 40 from detaching from the joint assembly 30 automatically. FIG. 13 shows the projections 323 are going to be rotated to engage with the combined portions 313. The flexible projections 323 are slightly deformed to insert gaps between the combined portions 313 and the space 44 first and further completely engage with the combined portions 313. Then, the flexible projections 323 and the combined portions 313 are released so that the above combination would be tightly-coupled as shown in FIG. 14.

Figure 4:
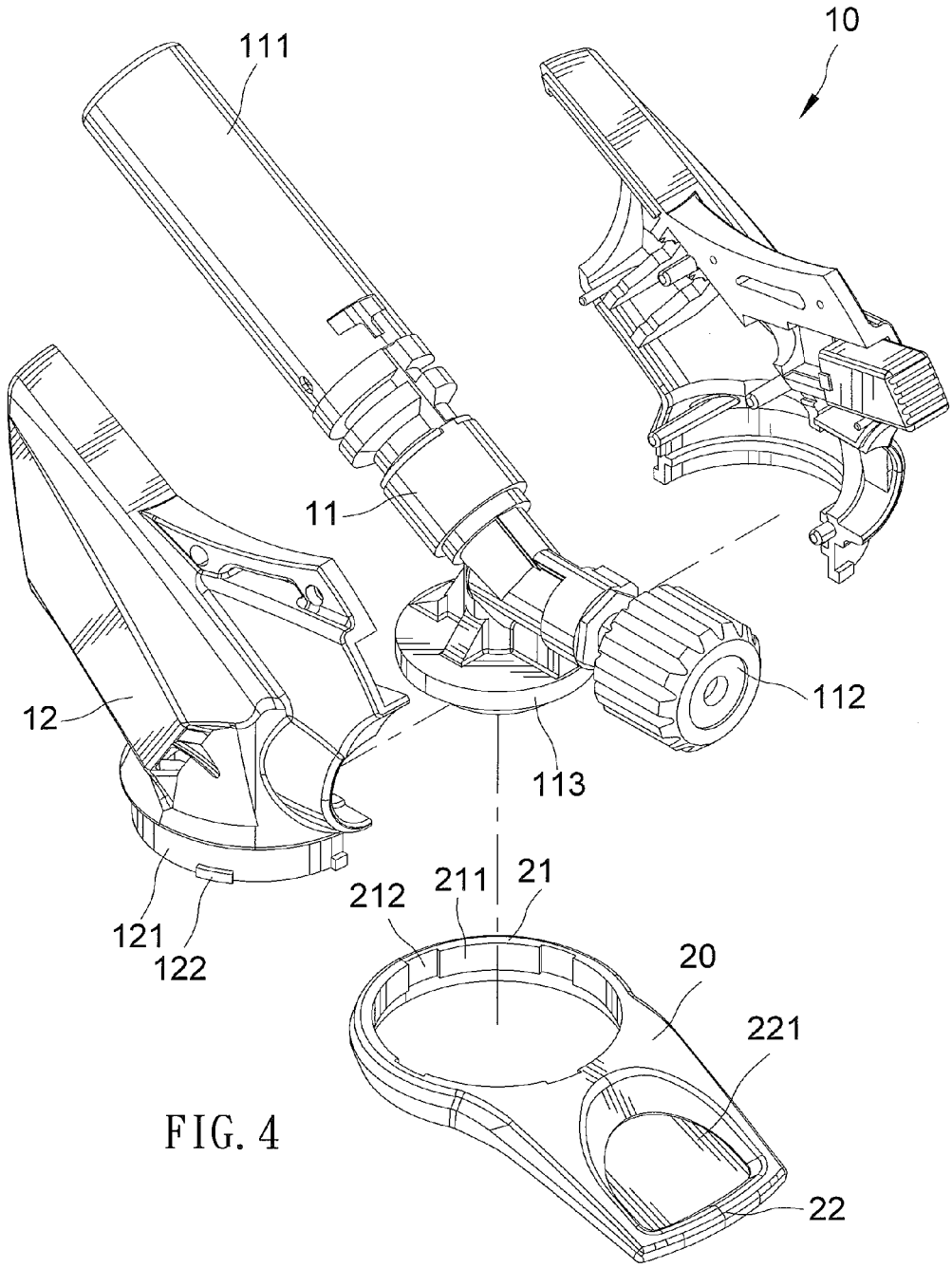
FIG. 4 is a partial, exploded perspective view of the gas torch shown in FIG. 1.
Figure 5:
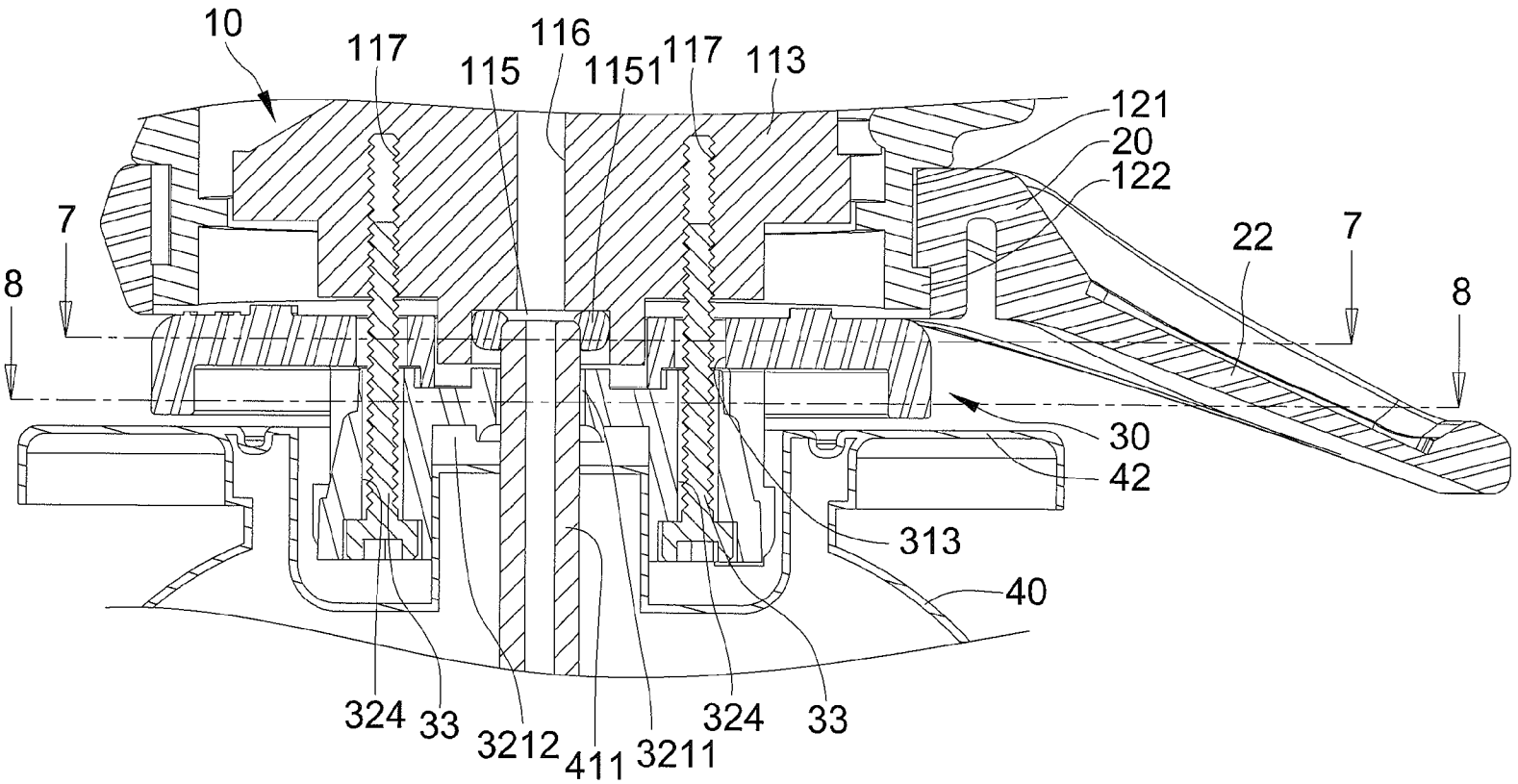
FIG. 5 is a cross-sectional view taken along line 5-5 in FIG. 1.
Figure 6:
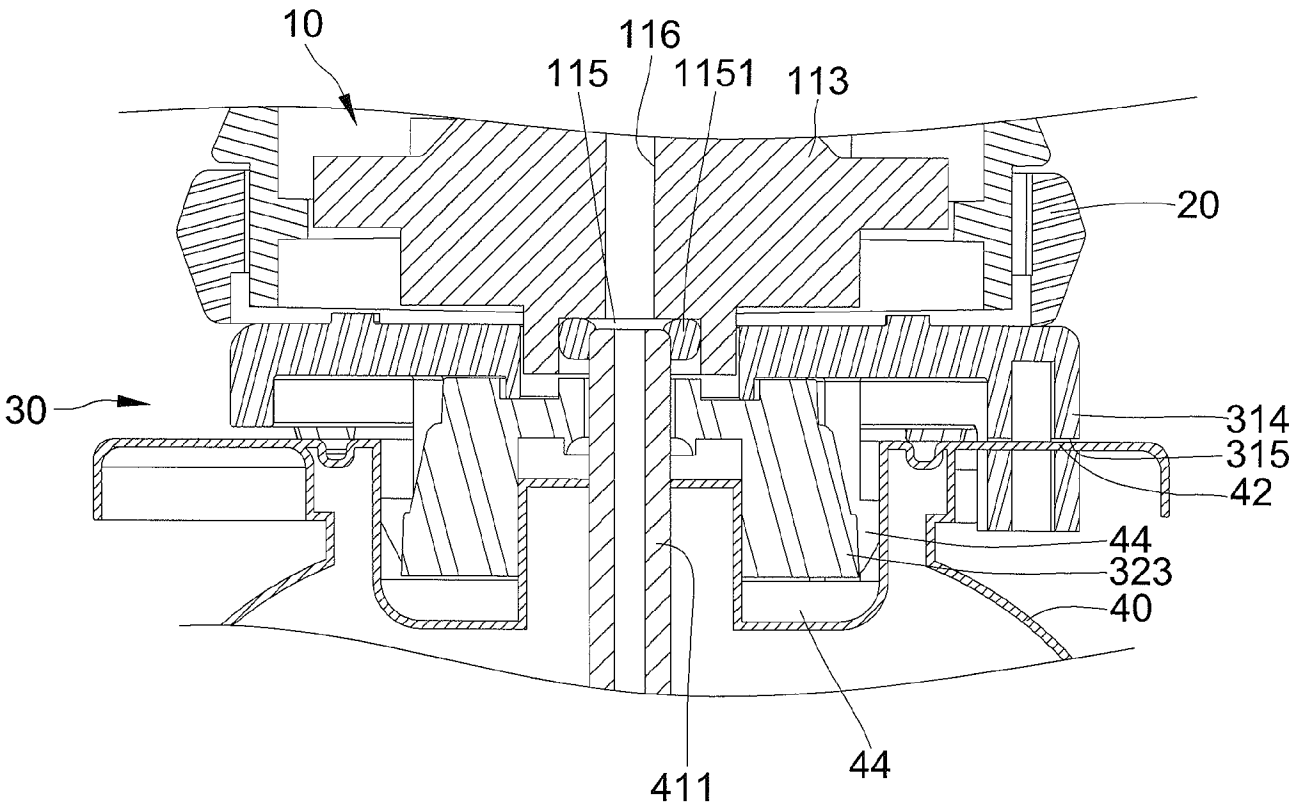
FIG. 6 is a cross-sectional view taken along line 6-6 in FIG. 1.
Figure 16:
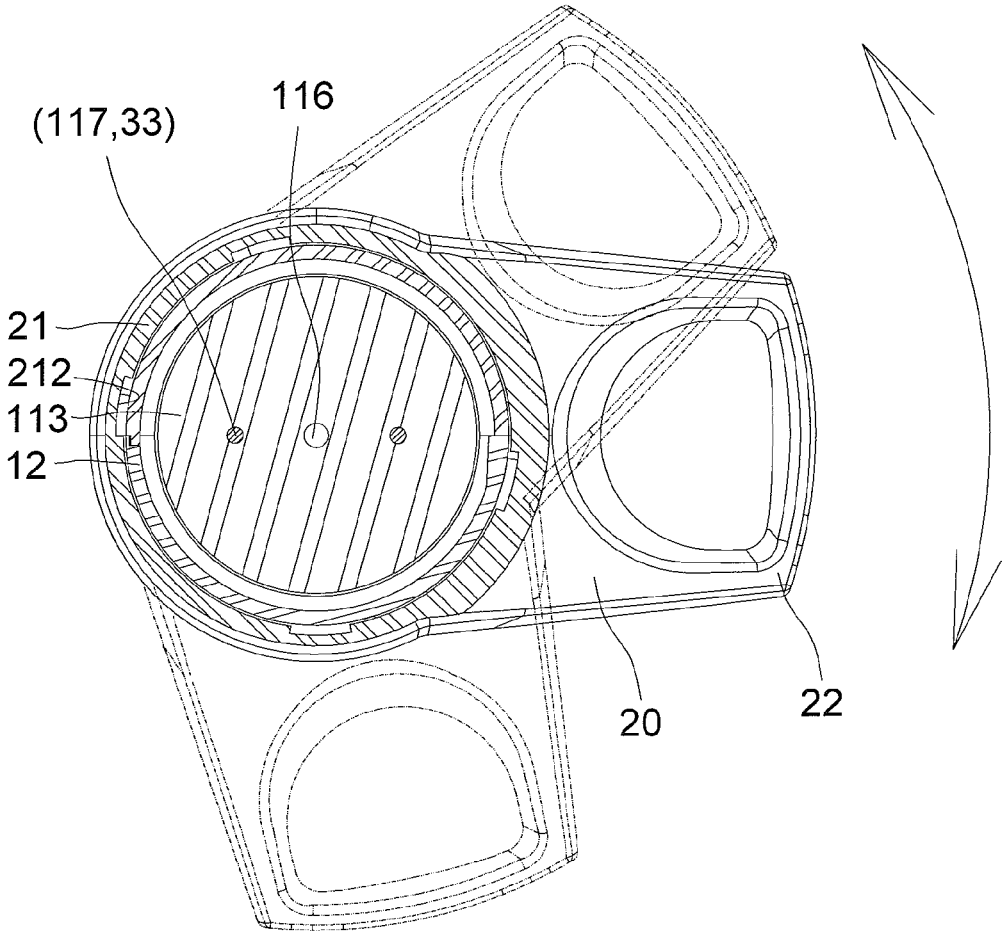
FIG. 16 is a top view of the gas torch shown in FIG. 1.
Figure 17:
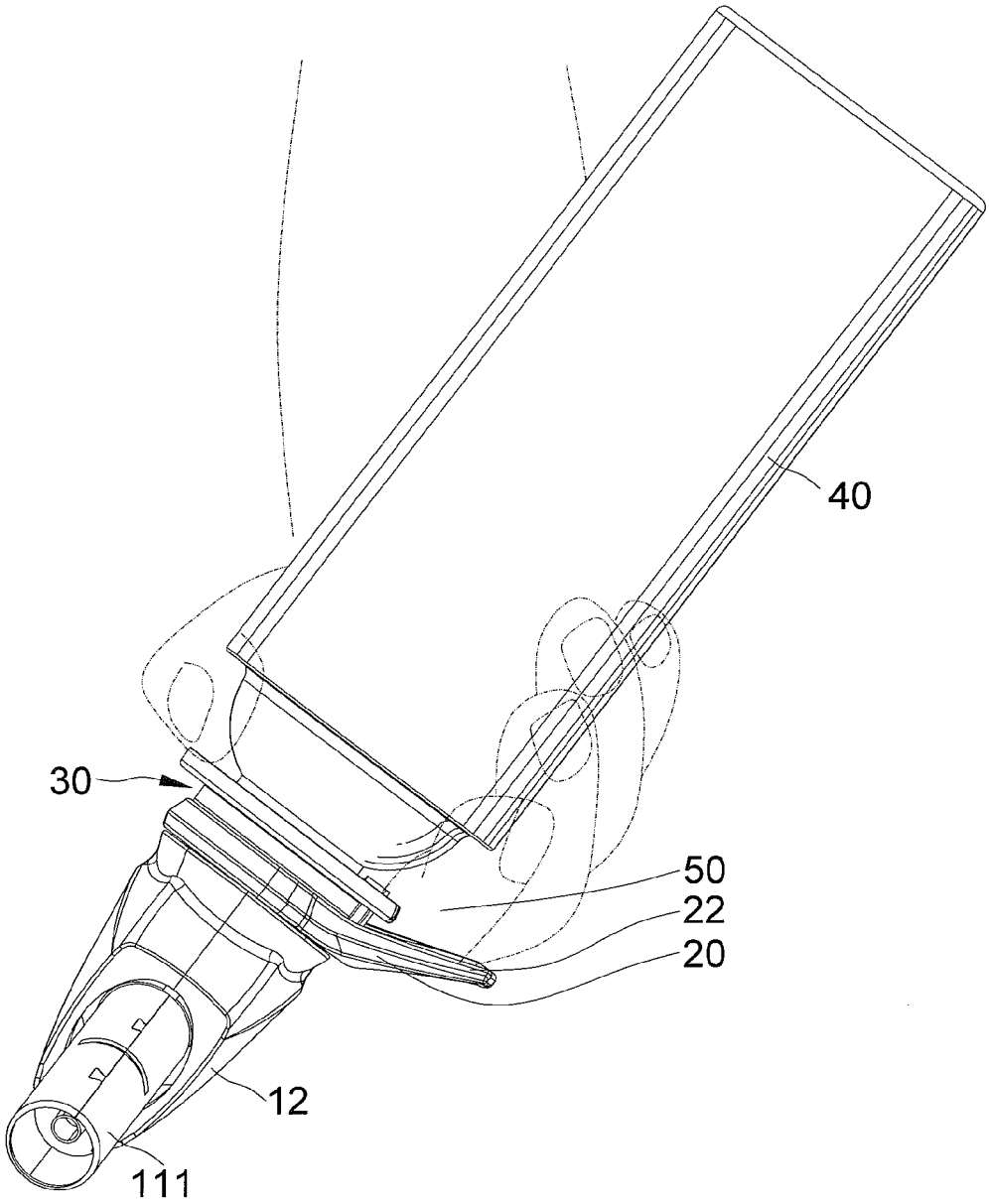
FIG. 17 is a front view of the gas torch shown in FIG. 1, illustrating a user's hand holding on the bottled gas tank.

Referring to FIGS. 15 through 17, the user's hand can be placed to the compartment 50 which is defined between the engagement plate 20 and the bottled gas tank 40. Moreover, because the engagement plate 20 is tilted toward the direction opposite the torch head assembly 10, the user's hand is not easy to detach from the compartment 50 and can stably hold the gas torch. The engagement plate 20 can be driven to rotate with respect to the connected portion 121 of the torch head assembly 10 (as shown in FIG. 4) so that the torch head 11 can be driven to various angles with respect to the joint assembly 30.

Figure 18:
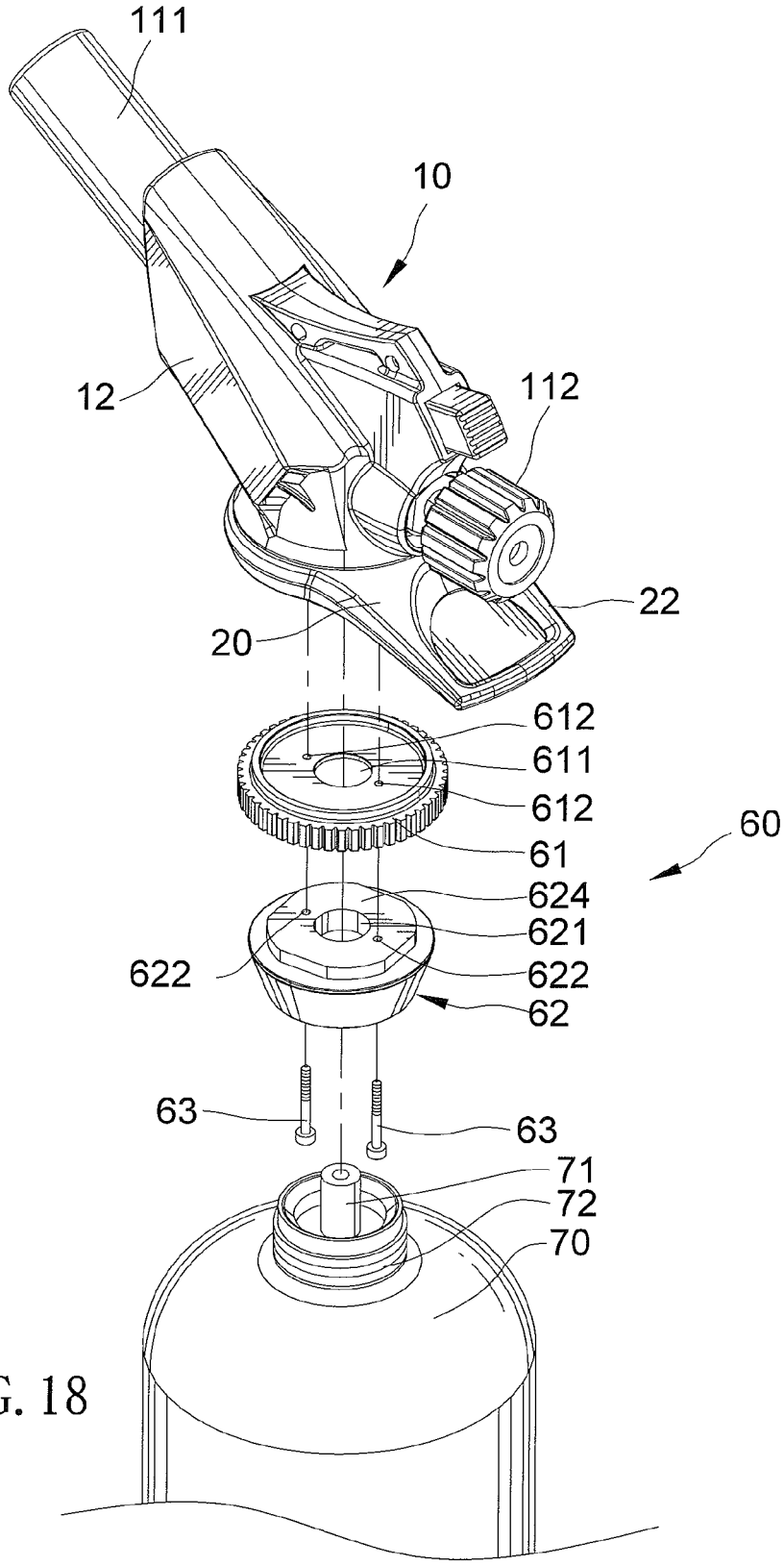
FIG. 18 is an exploded perspective view of a gas torch according to the second embodiment of the present invention.
Figure 19:
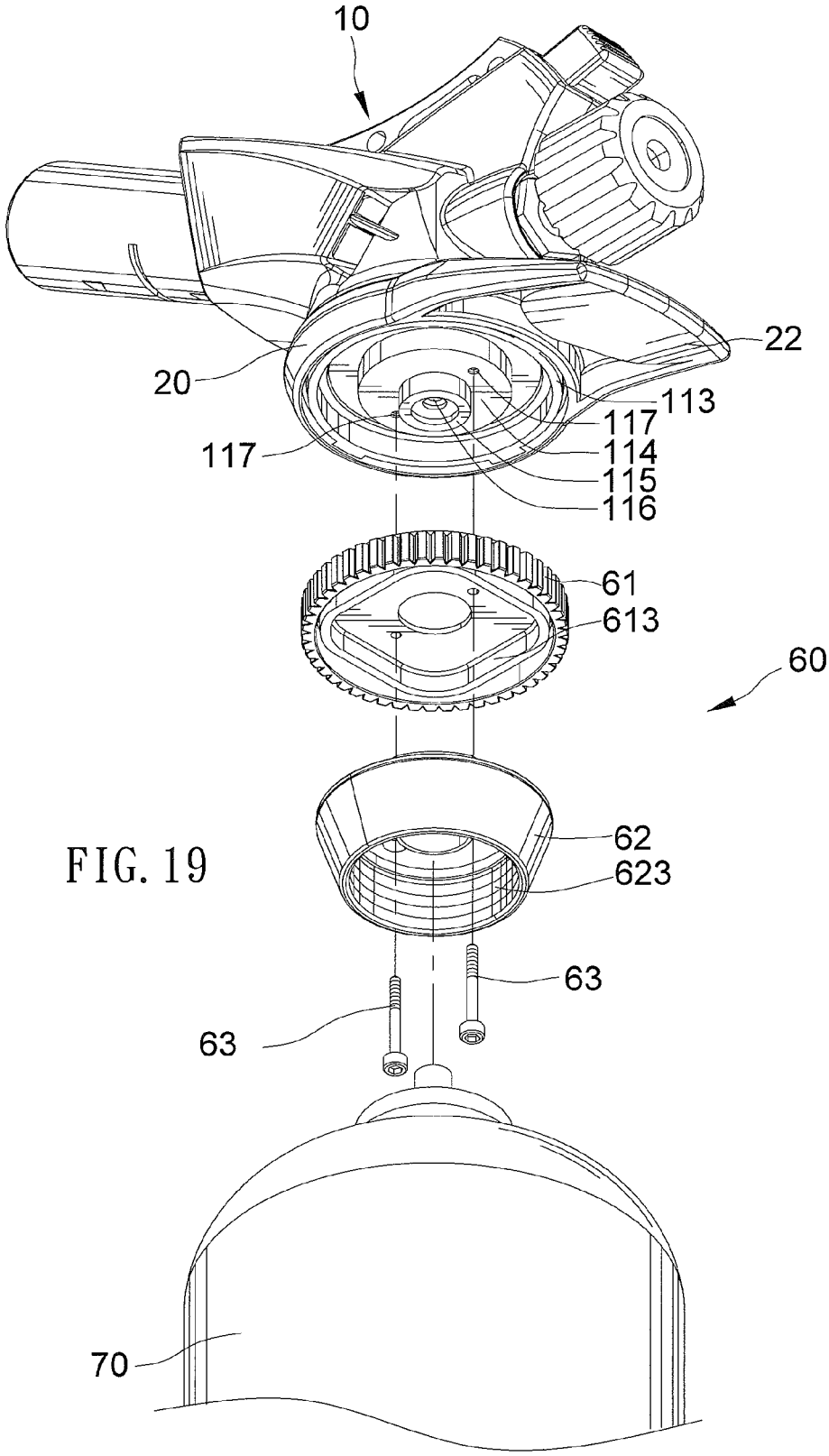
FIG. 19 is another exploded perspective view of the gas torch shown in FIG. 16.
Figure 20:
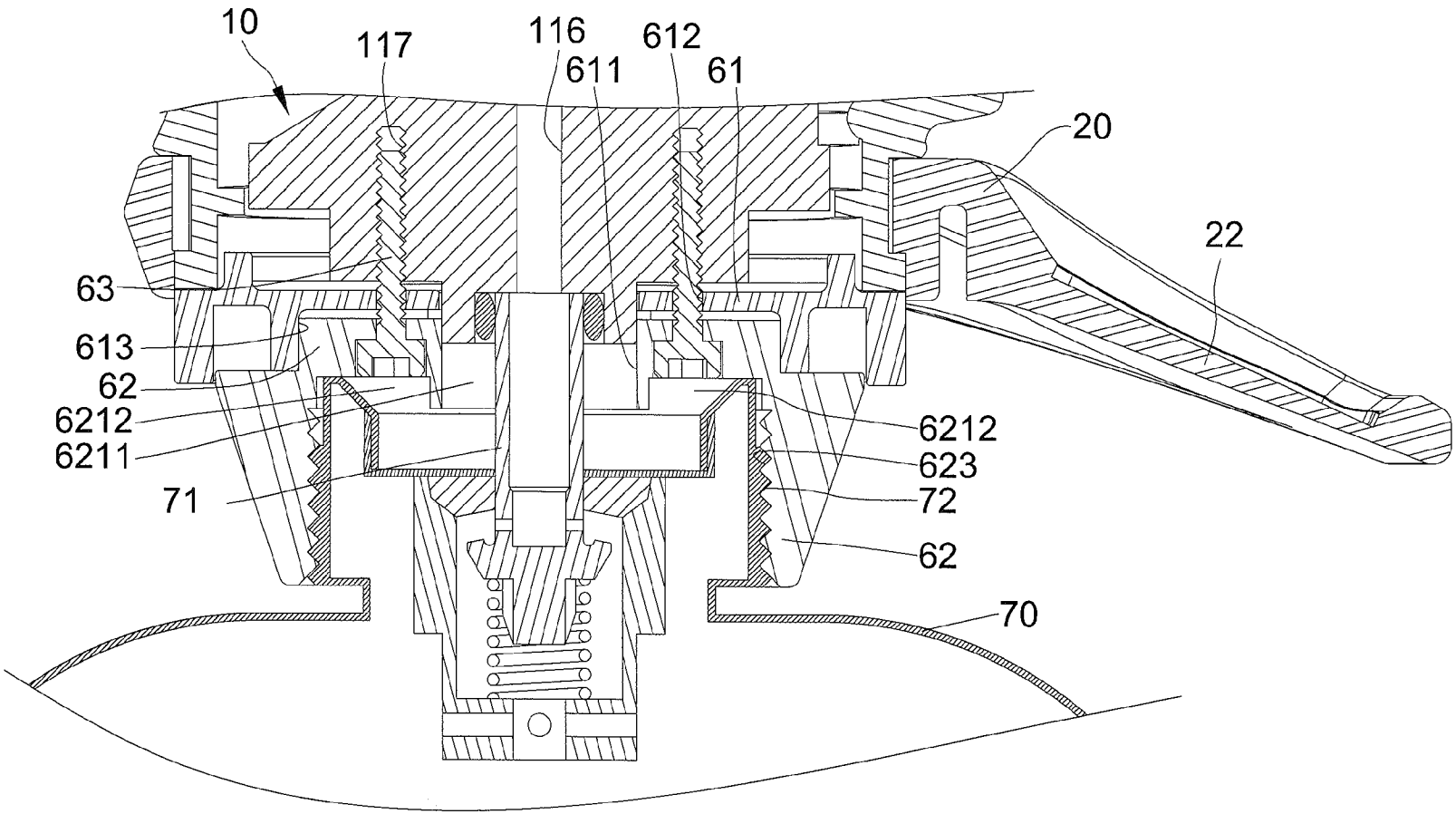
FIG. 20 is a partial, cross-sectional view of the gas torch shown in FIG. 16.

FIGS. 18 through 20 show a gas torch in accordance with a second embodiment of the present invention similar to the first embodiment except several features as follows. Firstly, a joint assembly 60 replaces the joint assembly 30 and allows the torch head assembly 10 to connect to different kinds of gas tanks. Secondly, a bottled gas tank 70 replaces the bottled gas tank 40 and is in the form of a camp power gas tank. The bottled gas tank 70 includes a nozzle 71 protruding from the center thereof and a threaded portion 72 formed around the outer periphery of the nozzle 71.

The joint assembly 60 includes a first joint member 61 coupling the joint assembly 60 to the torch head assembly 10 and a second joint member 62 communicating with the first joint member 61 and adapted for connecting to the bottled gas tank 70. The first joint member 61 includes a through-hole 611 mounted to the coupled portion 115 and two opposite limited holes 612 formed thereon around the periphery of the through-hole 611. In this case, the limited holes 612 are in the form of circular orifices. The top side of the first joint member 61 is abutted against the coupled base 113, and the bottom side of the first joint member 61 has a receiving portion 613 connected to the second joint member 62.

The second joint member 62 includes an orifice 621 communicating with the through-hole 611 of the first joint member 61 and the torch head assembly 10 and having first and second sections 6211 and 6212. The first section 6211 is adjacent to the first joint member 61, and the second section 6212 is away from the first joint member 61 with respect to the first section 6211. Two opposite engaged holes 622 are formed on the second joint member 62 around the orifice 621. Two fasteners 63 are adapted for inserting through the two engaged holes 622 and the limited holes 612 and engaged with the coupled holes 117, so that the joint assembly 60 is firmly coupled to the torch head assembly 10. An inner threaded portion 623 is partially formed inside of the orifice 621 opposite to the first joint member 61 and adapted to connect to the bottled gas tank 70 in a screw manner. An abutted portion 624 is formed on a side of the second joint member 62 for coupling to the receiving portion 613 of the first joint member 61 so that the first and second joint members 61 and 62 are combined to each other stably but not move with respect to each other. In this case, a profile of the inner periphery of the receiving portion 613 corresponds with a profile of the outer periphery of the abutted portion 624.

Figure 21:
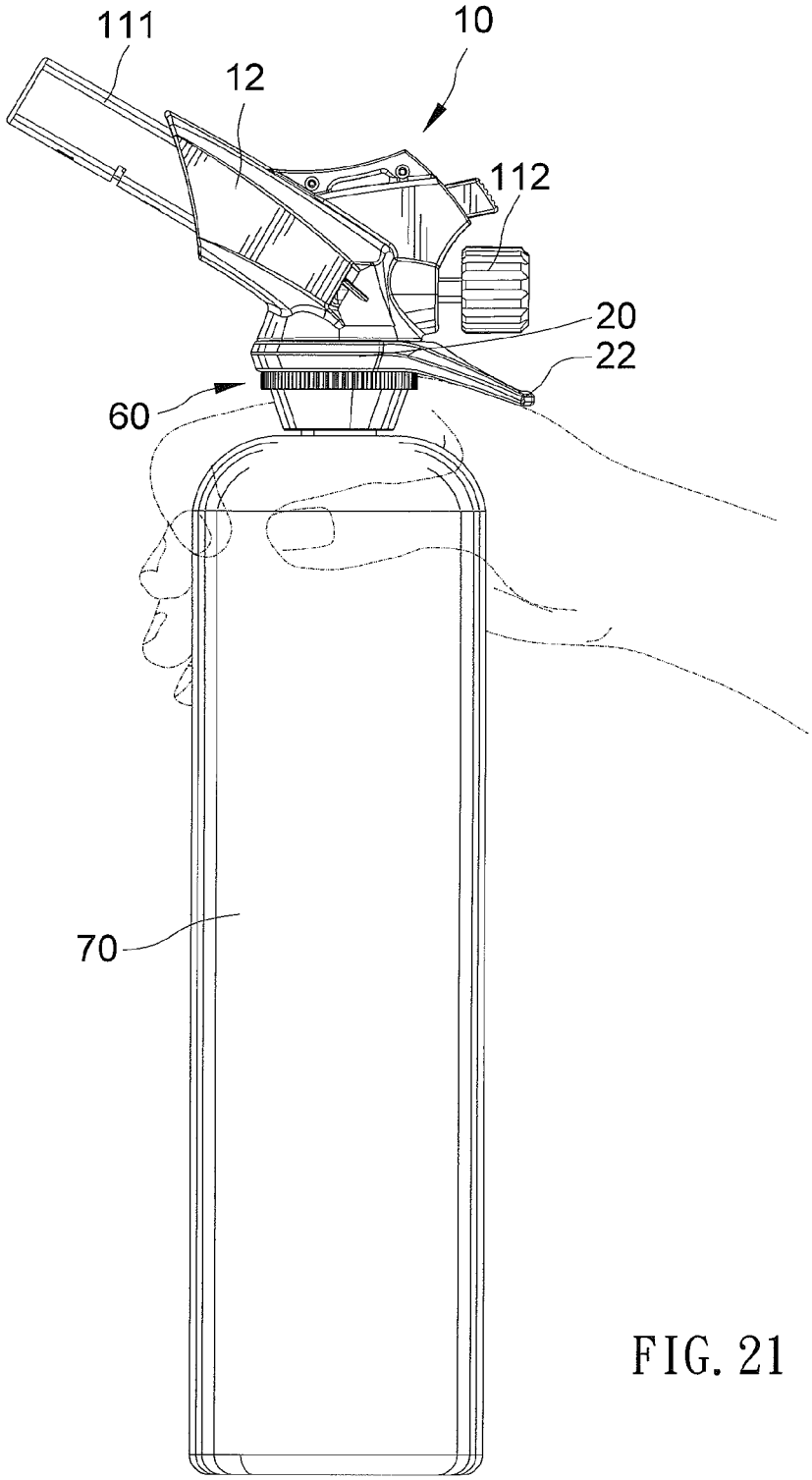
FIG. 21 is a side view of the gas torch shown in FIG. 16, illustrating a user's hand holding on the bottled gas tank.

Referring to FIG. 21, the user's hand can be placed between the engagement plate 20 and the bottled gas tank 70. Moreover, because the engagement plate 20 is tilted toward the direction opposite the torch head assembly 10, the user's hand can stably hold the gas torch. The engagement plate 20 can be driven to rotate with respect to the connected portion 121 of the torch head assembly 10 (as shown in FIG. 4) so that the torch head 11 can be driven to various angles with respect to the joint assembly 60.

While several embodiments of the invention have been shown and described, it will be apparent to those skilled in the art that modifications may be made therein without departing from the scope and spirit of the present invention.

What is claimed is:

1. A gas torch comprising:

a torch head assembly including a coupled base and a connected portion coupled to an outer periphery of the coupled base;

a joint assembly coupled to the coupled base and adapted for connecting to a nozzle of a bottled gas tank, with the joint assembly having a first joint member and a second joint member communicating with the first joint member, with the first and second joint members joined together in a tightly-coupled manner; wherein the torch head assembly connects to different kinds of gas tanks; and an engagement plate including a mounted portion mounted onto the connected portion and an engaged portion extending from the mounted portion transversely, with the engaged portion outwardly tilted toward a direction which is opposite to a direction of the torch head assembly, with the joint assembly communicating the torch head assembly with the bottled gas tank, with the engagement plate restricted between the joint assembly and the torch head assembly, with a user's hand being able to be placed between the engagement plate and the bottled gas tank for firmly holding the gas torch;

wherein the torch head assembly further includes a tube formed on an end thereof and an adjusting button provided at another end thereof; wherein a distance between a distal end of the engaged portion and a center of the nozzle is larger than a distance between an outer periphery of the bottled gas tank and the center of the nozzle or a distance between a distal end of the adjusting button and the center of the nozzle.

2. The gas torch as claimed in claim 1 wherein the torch head assembly includes a torch head and a casing covering two sides of the torch head, with the coupled base transversely installed to the torch head, with the connected portion formed on the casing and corresponding to the coupled base.

3. The gas torch as claimed in claim 1 further comprising a compartment defined between the engagement plate and the bottled gas tank, with the user's hand being able to be placed in the compartment.

4. The gas torch as claimed in claim 3 wherein the bottled gas tank includes a neck connecting a body of the bottled gas tank to the nozzle of the bottled gas tank, with the compartment defined between the neck and the engagement plate.

5. The gas torch as claimed in claim 1 further comprising a receptacle formed on the engaged portion for setting labels or trademarks thereupon.

6. The gas torch as claimed in claim 1 further comprising a channel communicating with the bottled gas tank for gas passing through.

7. The gas torch as claimed in claim 1 wherein two fasteners are inserted through the first and second joint members and engaged with the coupled base of the torch head.

8. The gas torch as claimed in claim 7 further comprising an abutted portion and a coupled portion defined on a bottom side of the coupled base, with the coupled portion protruding from a center of the abutted portion, with two opposite coupled holes formed on the abutted portion and surrounding the coupled portion, with the first joint member having a through-hole mounted onto the coupled portion, with the two fasteners inserted through the first and second joint members and engaged with the two opposite coupled holes of the torch head.

9. The gas torch as claimed in claim 8 wherein the first joint member includes two limited holes formed thereon around the through-hole and the second joint member includes two engaged holes, with the two fasteners inserted through the two limited holes and the two engaged holes.

10. The gas torch as claimed in claim 9 wherein the second joint member rotates with respect to the first joint member via the two fasteners moved along the two limited holes of the first joint member.

11. The gas torch as claimed in claim 10 wherein each of the limited holes is in a form of a long groove.

12. The gas torch as claimed in claim 8 wherein the bottled gas tank further includes an engaged disc surrounding the nozzle and having a gap opened outwardly, with a space defined between the nozzle and the engaged disc; wherein the first joint member includes several combined portions and a block formed on a side thereof opposite to the coupled base, with the block forming with a slot; and wherein the second joint member includes several projections and several receptacles formed on an outer periphery thereof, with each receptacle defined between each two of the several projections, with each receptacle inserted by the related one combined portion, with the several combined portions and the several projections abutted against an inner side of the space, with the block inserted through the gap and during rotation of the second joint member, the slot is engaged with the engaged disc.

13. The gas torch as claimed in claim 12 wherein an inner diameter of each combined portion is larger than an outer diameter of each receptacle and smaller than an outer diameter of each projection.

14. The gas torch as claimed in claim 12 wherein the first joint member has four combined portions and the second joint member has four projections and four receptacles.

15. The gas torch as claimed in claim 12, with the several combined portions and the several projections being flexible.

16. The gas torch as claimed in claim 15, wherein the combined portions, the several projections and the space form a tightly-coupled combination.

17. The gas torch as claimed in claim 8 wherein the bottled gas tank includes a threaded portion formed on an outer periphery thereof; and wherein the first joint member includes a combined portion formed on a side thereof opposite to the coupled base and the second joint member includes an inner threaded portion formed inside thereof and engaged with the threaded portion of the bottled gas tank in a screw manner, and an abutted portion coupled to the combined portion of the first joint member.

18. A gas torch comprising:

a torch head assembly including a coupled base, a connected portion coupled to an outer periphery of the coupled base, a torch head and a casing covering two sides of the torch head, with the coupled base transversely installed to the torch head, with the connected portion formed on the casing and corresponding to the coupled base;

a joint assembly coupled to the coupled base and adapted for connecting to a nozzle of a bottled gas tank, with the joint assembly having a first joint member and a second joint member communicating with the first joint member, with the first and second joint members joined together in a tightly-coupled manner; wherein the torch head assembly connects to different kinds of gas tanks;

an engagement plate including a mounted portion mounted onto the connected portion and an engaged portion extending from the mounted portion transversely, with the engaged portion outwardly tilted toward a direction which is opposite to a direction of the torch head assembly, with the joint assembly communicating the torch head assembly with the bottled gas tank, with the engagement plate restricted between the joint assembly and the torch head assembly, with a user's hand being able to be placed between the engagement plate and the bottled gas tank for firmly holding the gas torch;

several limited protrusions formed on the outer periphery of a distal end of the connected portion;

a flange defined on an inner periphery of the mounted portion; and several notches formed on the flange and spaced from each other, with the several notches inserted by the several limited protrusions.

* * * * *